US006564680B1

(12) United States Patent
Rinner et al.

(10) Patent No.: US 6,564,680 B1
(45) Date of Patent: May 20, 2003

(54) HAND-MANIPULATED TORQUE TOOL

(75) Inventors: James A. Rinner, Racine, WI (US); Guy L. Bradshaw, Kenosha, WI (US)

(73) Assignee: Beere Precision Medical Instruments, Inc., Kenosha, WI (US)

( * ) Notice: Subject to any disclaimer, the term of this patent is extended or adjusted under 35 U.S.C. 154(b) by 254 days.

(21) Appl. No.: 09/706,889

(22) Filed: Nov. 6, 2000

(51) Int. Cl.[7] ..... B25B 23/16
(52) U.S. Cl. ..... 81/177.5; 81/489
(58) Field of Search ..... 81/177.8, 177.9, 81/177.5, 177.7, 177.2, 450, 489

(56) References Cited

U.S. PATENT DOCUMENTS

| | | | | | |
|---|---|---|---|---|---|
| 579,277 | A | * | 3/1897 | Lord et al. | 81/177.8 |
| 821,328 | A | * | 5/1906 | Bartlett | 81/450 |
| 1,776,928 | A | * | 9/1930 | Potts | 81/450 |
| 3,270,597 | A | * | 9/1966 | Neff et al. | 81/177.9 |
| 3,779,107 | A | * | 12/1973 | Avery | 71/177.8 |
| 4,170,909 | A | | 10/1979 | Wagner | |
| 4,542,667 | A | | 9/1985 | Jang | |
| 4,676,703 | A | | 6/1987 | Swanson | |
| 4,825,734 | A | | 5/1989 | Schwalbe et al. | |
| 4,848,197 | A | | 7/1989 | Kikel | |
| 5,069,091 | A | | 12/1991 | Bramsiepe | |
| 5,101,696 | A | | 4/1992 | Neff | |
| 5,193,419 | A | * | 3/1993 | Lee | 81/177.5 |
| 5,450,775 | A | | 9/1995 | Kozak | |
| 5,515,754 | A | * | 5/1996 | Elkins | 81/177.9 |
| 5,943,925 | A | * | 8/1999 | Huang | 81/177.8 |
| 6,055,889 | A | | 5/2000 | Rinner | |
| 6,148,698 | A | * | 11/2000 | Hsieh | 81/177.8 |
| 6,401,576 | B1 | * | 6/2002 | Wu | 81/177.8 |
| 6,405,620 | B2 | * | 6/2002 | Liao | 81/177.7 |

* cited by examiner

*Primary Examiner*—James G. Smith
(74) *Attorney, Agent, or Firm*—Arthur J. Hansmann

(57) ABSTRACT

A hand manipulated torque tool, such as a screwdriver, having two handle portions pivotal between two modes of a straight relationship and a right angle relationship which forms a T-handled tool. A lock mechanism is operative between the handle portions to releasably hold the portions in the selected modes. The mechanism is accessible from the exterior of the tool, and it is operated by user finger pressure and it automatically re-locks upon release of the pressure and the subsequent pivoting of one handle portion to either of the two positions.

17 Claims, 2 Drawing Sheets

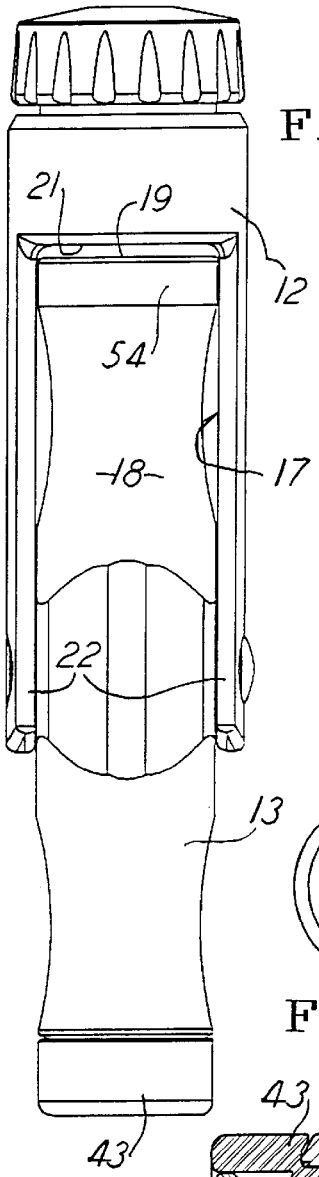
Fig.3
Fig.10
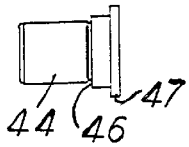
Fig.5
Fig.9
Fig.11
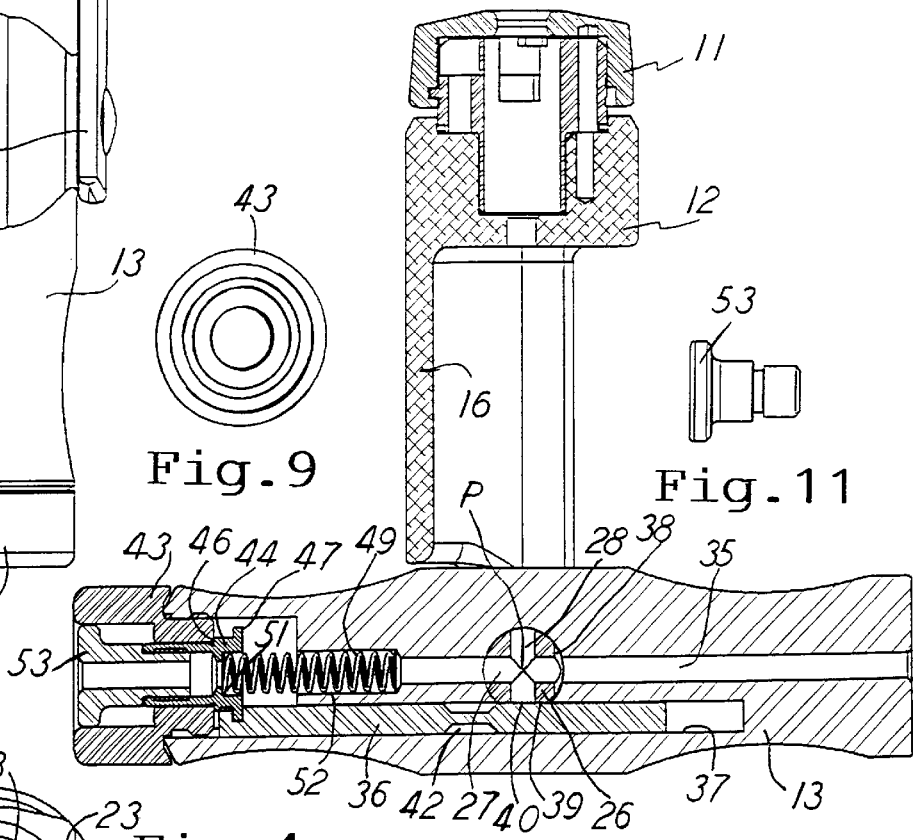
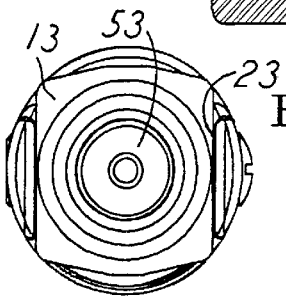
Fig.4
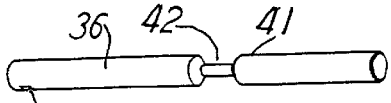
Fig.8

HAND-MANIPULATED TORQUE TOOL

This invention relates to a hand-manipulated torque tool, and more particularly, it relates to a torque tool which is optionally positionable between a straight handle configuration and a T-handle configuration.

BACKGROUND OF THE INVENTION

The prior art is aware of hand-manipulated torque tools which can optionally be positioned between straight and T-handle configurations.

This invention improves upon the prior art by providing a hand-manipulated torque tool that is sturdy, is easily positionable in its two positions, is not subject to being inadvertently positionable nor releasable relative to those two positions, is securely held in both two positions, and presents a substantial and firmly grippable handle in both two positions.

The tool of this invention is precision made, and, as such, it is useful in highly precise functions such as in the medical arts where orthopedic surgery is performed and screws are applied to a patient's skeleton, or in other precision applications. It is also arranged for rotatably supporting a tool bit such as a screwdriver bit for a ratcheting action.

There is a release mechanism which permits the handle to be re-configured from its straight position to its T-handle position, and that mechanism is manually operated and it is in a location where there is no likelihood of the user inadvertently operating the release. That is, the user can grip the tool for using it in either of its two positions and not have his hand or fingers in a position which could inadvertently cause the release mechanism to be operated.

This invention also includes the method of maneuvering the tool to establish the two working positions.

BRIEF DESCRIPTION OF THE DRAWINGS

FIG. 3 is a right side elevational view of the tool of FIG. 1 but in the straight position.

FIG. 4 is an end elevational view of FIG. 3.

FIG. 5 is a sectional view on the plane designated 5—5 in FIG. 2.

FIG. 8 is a perspective view of a locking part seen in FIG. 5.

FIG. 9 is a left end elevational view of the end of a part of FIGS. 1 and 5.

FIGS. 10 and 11 are front elevational views of two parts seen in FIG. 5.

DETAILED DESCRIPTION OF THE PREFERRED EMBODIMENT AND METHOD

Figures 1, 2, 6, 7, 12:
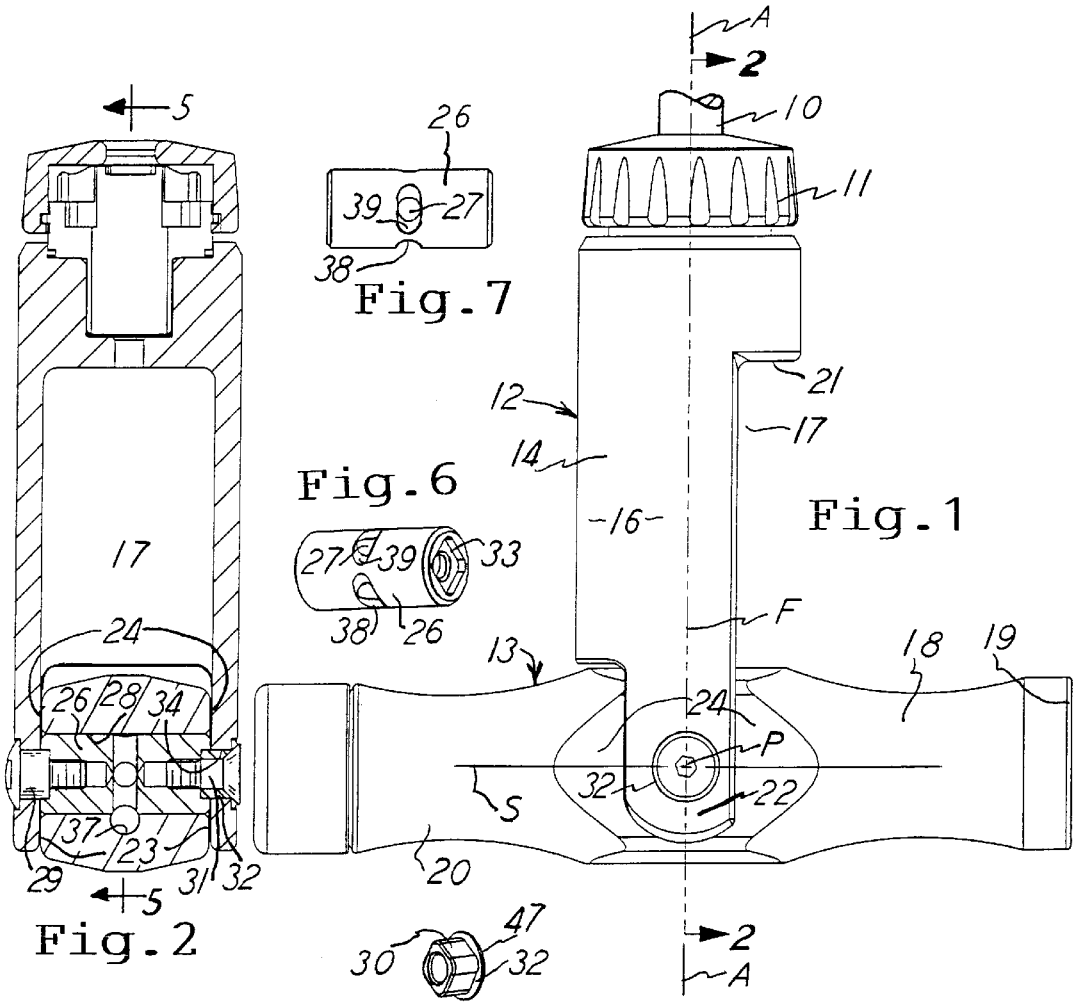
FIG. 1 is a side elevational view of the tool of this invention in its T-handle position.
FIG. 2 is a sectional view on the plane designated 2—2 in FIG. 1.
FIG. 6 is a perspective view of a pivot post seen in FIGS. 2 and 5.
FIG. 7 is a side elevational view of the pivot post of FIG. 6.
FIG. 12 is a perspective view of a part seen in FIG. 2.

This torque tool can releasably receive a tool bit designated 10, and that may be a screwdriver bit which is chucked and ratcheted in the ratcheting mechanism which may be of any suitable construction at the tool end 11. The ratcheting mechanism is seen in FIG. 5, and it has a heretofore known construction for driving the bit in either selected direction of rotation about the longitudinal axis A of the tool.

There are two handle portions 12 and 13 which, as seen in FIGS. 1 and 3, can be positioned in the T-handle position of FIG. 1 and the straight or aligned position of FIG. 3. Both handle portions 12 and 13 are cylindrical and have a respective longitudinal axis extending along the respective lengths of each, namely, axis F and axis S. In the FIG. 3 position, the axes F and S are in alignment with each other and with axis A, and in the FIG. 1 position the axis S is positioned at a right angle to axis F. The two portions 12 and 13 are pivotally related by having the portion 13 pivotal on the portion 12 at a pivot axis P which is transverse to the lengths of each of the portions 12 and 13. Handle portions 12 and 13 are substantially the same length, and the pivot axis P is at one end of portion 12 and it is at a mid-point or the center of the portion 13.

The portion 12 has a hollow cylindrical body 14 with a wall 16 therealong and an opening 17 opposite the wall 16. It is through the opening 17 that the handle portion 13 swings to and from alignment with the handle portion 12. Thus handle portion 13 half-length 18 extends from the pivot axis P to an end 19 and adjacent a transverse wall 21 which is the back wall for the ratcheting mechanism 11, and as seen in FIG. 3. The handle portion 13 has a remaining half-length 20 which extends in alignment with, and as an extension of, the handle portion 12 in the FIG. 3 mode.

The portion 12 also has two spaced-apart legs 22 extending from the wall 16. The space between the legs 22 is substantially the same as the cross-sectional dimension of the handle portion along the pivot axis P, and thus the handle portion 13 is snugly supported by and between the legs 22.

This invention provides for the apparatus and method for a hand tool which can optionally be placed in either the aligned position of FIG. 3 or the T-handle position of FIGS. 1, 2, and 5. In both modes, there is a releasable locking mechanism which securely holds the handle portion 13 in the selected one of those two modes. To accommodate those two modes, it will be seen that the wall 16 spans an arc of approximately 240 degrees about the axis F, and that arrangement leaves the opening 17 of approximately 120 degrees. Supporting legs 22 have two inside surfaces 23 which are flat and are parallel to each other for snug support of the mid-section of the pivotal handle portion 13 which has its own two flat surfaces 24 to match with the respective surfaces 23. Beyond that, the handle portion 13 is circular in cross section but of varying diameter along its length, as shown.

The pivotal mounting of the handle portion 13 is on a pivot post 26 which is secured by the legs 22. FIGS. 2, 5, and 6 show that the post 26 is cylindrical and hollow and has transverse openings 27 therethrough. The handle portion 13 has a cylindrical opening 28 extending therethrough for snug mounting of the handle 13 on the post 26. The two ends of the post are threaded and respectively receive screws 29 and 31 for holding the post 26 on the legs 22.

Additionally, as seen in FIGS. 2 and 12, there is a square insert 32 with an angularly shaped end 30, and the screw 31 passes throught insert 32 and then holds the insert 32 in an opening 33 in the post 26 and also in an opening 34 in the one leg 22. The openings 33 and 34 match the angularity of the insert end 30. In that manner, the post 26 is always held in a fixed position and against rotation on the legs 22. So the handle portion 13 pivots relative to the handle portion 12 but the pivot post does not pivot or rotate. Any suitable non-rotatable arrangement for the post 26 will suffice.

It will be noted that the handle portion 13 has a longitudinal central opening 35 that aligns with the post openings 27, and the entire construction is arranged with a complete central passageway through the tool, as seen in FIG. 5.

FIG. 5 shows there is a locking mechanism which includes a cylindrical rod or pin 36 slidably disposed in a cylindrical opening 37 in the handle portion 13. The rod 36 and the opening 37 intersect the handle portion 13 transverse opening 28 and is akin to being tangential thereto. It will also be seen in FIG. 5 that the post 26 has two surfaces 38 and 39 disposed adjacent to each other and at right angles to each other. The surfaces 38 and 39 are formed from semi-circular cutouts in the post 26, as shown in FIG. 7. The size of the two arcs formed by the two cutouts matches the cross-sectional circular shape of the rod, and thus the rod 36 snugly nests on the surfaces 38 and 39, in accord with the selected mode for the handle portion 13.

Therefore, with the handle portion in the FIG. 1 T-handle mode, the circumference portion 41 of the rod presents a straight surface 40 along the length of the rod 36 and that straight surface nests in the semi-circular shape 39 for a significant length along the rod 36, and thus the handle portion 13 is releasably held in the shown T-handle mode relative to the handle portion 12. The handle portion 13 can not then pivot on the post 26.

To release the T-handle mode and place the tool in the aligned mode, the rod 36 is slid along the cylindrical opening 37 to a position where a relief 42 in the rod 36 is adjacent the post 26. That relieves the tool from the T-handle mode and the user can then pivot the handle portion 13 to the aligned mode. A sleeve 43 is threaded into the end of the handle portion 13 and it slidably receives a cylindrical interconnector 44 which moves back and forth along the axis S. A shoulder 46 on the connector 44 abuts the end of the sleeve 43 to limit the movement leftward as viewed in FIG. 5.

The connector 44 has a flange 47 which is received in a notch 48 in the rod 36 to thus establish the axial position of the rod 36 in accord with the position of the connector 44. A compression spring 49 abuts a shoulder 51 on the connector 44 and exerts a force between the connector 44 and the bottom of a bore 52 in the handle portion 13 to thus urge the connector 44 and the attached rod 36 leftwards as viewed in FIG. 5.

There is a button 53 slidable on the end of the handle portion 13 and it is threadedly connected with the connector 44. While the button 53 is counter-sunk in the sleeve 43, it can be finger depressed to move the rod 36 rightwards and thereby place the rod relief 42 adjacent the post 26 to release the lock of the handle portion 13 relative to either on of its setting modes.

In that arrangement and method, there is a positive lock between the handle portions 12 and 13 and only a specific maneuver of pressing on the button 53 will release the locking mechanism. In the aligned mode, the post surface 38 is in abutment with the rod circumference to thereby hold the tool in that aligned mode.

Throughout this description, the method of achieving the two modes of alignment and T-handle have been described. The user maneuvers the lock mechanism described by inserting a finger into the sleeve 43 and onto the button 53 and depresses the button to release the lock against the force of the spring 49. Once the lock is released, the user need only slightly pivot the handle portion 13, then release finger pressure, and then continue to pivot the handle portion 13 to its next position of alignment or right angle disposition, as desired, and the lock will snap into its locked mode. Thus, upon release of finger pressure on the button 53 and positioning the handle portion 13, the lock mechanism will automatically return to the lock position. There is the audible click when seating into the lock position so the user then knows that the lock is in its operative position.

Movement to the finality of the selected mode will cause the connector shoulder 46 to abut the adjacent end of the sleeve 43 in that locked and non-pivotal securement of the handle portion 13, as seen in FIG. 5. Also, the two handle ends 18 and 20 are of a similar cylindrical shape for optimum gripping in the T-handle mode. With the spring 49 always urging the rod 36 toward its locked position where the surfaces 41 and 38 or 39 are aligned and in contact with each other, the two handle modes are secured and subject only to the user depressing the button 53 to release the lock mechanism. Also, in arriving at the locked position where the surface 41 abuts the selected one of the surfaces 38 and 39, an audible sound of a click will be produced to tell the user that the locked mode has been achieved.

Of course the lock mechanism is accessible from the exterior of the handle portion 13 and through the button 53 which can be considered to be a part of the lock mechanism. The post 26 is considered to be an engager which is cooperative with the lock mechanism.

In addition to the stability provided by the contacting surfaces 23 and 24 being in snug contact with each other and held toward each other by the screws 29 and 31, an end 54 of the handle portion 13 snugly nests within the arcuate wall 16, as best seen in FIG. 3. That provides further sturdiness of the tool in its aligned mode.

What is claimed is:

1. A hand-manipulated torque tool comprising:

a first handle having a longitudinal axis and a pivot axis extending transverse to said longitudinal axis and having a receptor for supporting a work tool and having a cavity therein extending parallel to said longitudinal axis, an elongated second handle having a length and two terminal ends and being pivotally connected with said first handle on said pivot axis and at a mid-length location along said length and being pivotal to a position within said cavity for alignment with said longitudinal axis and a position out of said cavity to be transverse to said longitudinal axis to present a T-handle and with a first one of said terminal ends pivotal into and out of said cavity and a second one of said terminal ends always extendable to the side of said pivot axis away from said first handle, an engager on said first handle, a manually actuated locking member movably supported on said second handle and being movable independent of any movement of said second handle and always being exposed on said second terminal end for manual actuation and being cooperative with said engager to lock and non-lock modes for said handles and for releasably restraining said second handle alternately in said positions, and a spring yieldingly urging said locking member in said lock mode.

2. The hand-manipulated torque tool as claimed in claim 1, wherein:

said locking member has an actuation button connected thereto and with said button always being exposed exteriorly of said second terminal end for moving said locking member transverse to said pivot axis for the lock and non-lock modes.

3. The hand-manipulated torque tool as claimed in claim 2, wherein:

said engager has two surfaces thereon and said surfaces are arranged to respectively establish said positions, and said locking member is a pin extending interiorly of said second handle and transverse to said pivot axis and is disposed to contact said two surfaces for locking in said two positions.

4. The hand-manipulated torque tool as claimed in claim 1, wherein:

said cavity and said first terminal end are of equal size whereby said cavity completely snugly receives one-half of said length at said second terminal end.

5. A hand-manipulated torque tool comprising:

a first handle having a longitudinal axis and a pivot post presenting a pivot axis extending transverse to said longitudinal axis and having a receptor for supporting a work tool and having a cavity therein extending parallel to said longitudinal axis, a second handle having a total length and being pivotally mounted on said pivot post and at a mid-length of said second handle to extend equally to each side of said pivot axis and being pivotal to a position of alignment with said longitudinal axis and a position transverse to said longitudinal axis, a manually actuated locking member movably supported on said second handle and being movable independent of any movement of said second handle, said pivot post and said locking member having mutually engageable surfaces for precluding pivoting of said second handle when said surfaces are engaged with each other and thereby effect lock and non-lock modes of said second handle relative to said first handle and in said positions, and said locking member being accessible exteriorly of said second handle for the movement of said locking member and consequent movement of said locking member said surface relative to said pivot post said surface.

6. The hand-manipulated torque tool as claimed in claim 5, wherein:

said pivot post is fixedly mounted on said first handle to preclude movement of said pivot post relative to said first handle.

7. The hand-manipulated torque tool as claimed in claim 5, including:

a spring yielding urging said locking member to have said surfaces in contact with each other and thereby have said handles in said lock mode.

8. The hand-manipulated torque tool as claimed in claim 5, wherein:

said locking member has a relief therein adjacent said lock member surface and being positionable contiguous to said pivot post to establish said non-lock mode.

9. A hand-manipulated torque tool comprising:

a first handle portion having a longitudinal axis and having a receptor for supporting a work tool and having two spaced-apart legs, a pivot member affixed to and extending between said legs and presenting a pivot axis disposed transverse to said longitudinal axis, a second handle portion pivotally mounted on said pivot member and being pivotal about said pivot axis to a position of alignment with said longitudinal axis and alternatively to a position transverse to said longitudinal axis, a manually actuated locking member movably supported on said second handle portion and being movable independent of any movement of said second handle portion and being cooperative with said pivot member to establish lock and non-lock modes of said second handle portion relative to said first handle portion and for restraining said second handle portion alternately in said positions, said pivot member has two surfaces arranged to respectively establish said positions, said locking member is disposed to contact said two surfaces for locking said second handle portion in said two positions, and a spring yieldingly urging said locking member in said lock mode.

10. The hand-manipulated torque tool as claimed in claim 9, wherein:

said locking member has a relief therein and a locking locking member surface adjacent said relief and said relief being positionable contiguous to said pivot member surfaces upon movement of said locking member to establish said non-lock mode.

11. A hand-manipulated torque tool comprising:

a first handle portion having a longitudinal axis and having a receptor for supporting a work tool and having two spaced-apart legs, a post affixed to and extending between said legs and presenting a pivot axis disposed transverse to said longitudinal axis, a second handle portion pivotally mounted on said post and being pivotal about said pivot axis to a position of alignment with said longitudinal axis and alternatively to a position transverse to said longitudinal axis and having an end always disposed distal from said first handle portion throughout the pivoting to and between said positions, a manually actuated locking member movably supported on said second handle portion and being movable independent of any movement of said second handle portion and being cooperative with said post to establish lock and non-lock modes of said second handle portion relative to said first handle portion and for restraining said second handle portion alternately in said positions, a button movably supported on said end of said second handle portion and being in contact with said locking member for moving said locking member transverse to said pivot axis, and a spring yieldingly urging said locking member in said lock mode.

12. A hand-manipulated torque tool comprising:

a first handle portion having a longitudinal axis and a receptor for supporting a work tool, a second handle portion pivotally connected with said first handle portion and being pivotal on a pivot axis extending transverse to said longitudinal axis and being pivotal to a position of alignment with said axis and a position transverse to said axis, a fixed member fixedly supported by said first handle portion and is disposed and extends along said pivot axis and has two surfaces oriented to be respectively compatible with said positions, a locking member being elongated and extending transverse to said pivot axis for movement across said fixed member and being movably supported on said second handle portion and having a surface positionable in selective contact with said fixed member surfaces for respectively securing said second handle portion in said positions and with said locking member being movable independent of any movement of said second handle portion and to a location to have said locking member surface movable out of contact with said fixed member surfaces, said locking member having a relief therein adjacent said locking member surface and being positionable contiguous to said fixed member surfaces to establish said non-lock mode, and a spring operative on said locking member for yieldingly urging said locking member surface into contact with said fixed member surfaces.

13. The hand-manipulated torque tool as claimed in claim 12, wherein:

said fixed member two surfaces are straight and oriented at a right angle to each other and to thereby respectively establish said positions.

14. The hand-manipulated torque tool as claimed in claim 12, including:

a button movably supported on the exterior of said second handle portion and being in contact with said locking member for moving said locking member transverse to said pivot axis.

15. A hand-manipulated torque tool comprising:

a first handle portion having a longitudinal axis and a receptor for supporting a work tool, a second handle portion pivotally connected with said first handle portion and being pivotal on a pivot axis extending transverse to said longitudinal axis and being pivotal to a position of alignment with said axis and a position transverse to said axis, a fixed member being a pin fixedly supported by said first handle portion and is disposed and extends along said pivot axis and has a longitudinal axis extending along said pivot axis and has two surfaces oriented to be respectively compatible with said positions, a locking member being elongated and extending transverse to said pivot axis for movement across said fixed member and being movably supported on said second handle portion and having a surface positionable in selective contact with said fixed member surfaces for respectively securing said second handle portion in said positions and with said locking member being movable independent of any movement of said second handle portion and to a location to have said locking member surface movable out of contact with said fixed member surfaces, and a spring operative on said locking member for yieldingly urging said locking member surface into contact with said fixed member surfaces.

16. A hand-manipulated torque tool comprising:

a first handle portion having a longitudinal axis and a receptor for supporting a work tool, a second handle portion pivotally connected with said first handle portion and being pivotal on a pivot axis extending transverse to said longitudinal axis and being pivotal to a position of alignment with said axis and a position transverse to said axis, a fixed member fixedly supported by said first handle portion and is disposed and extends along said pivot axis and has two surfaces oriented to be respectively compatible with said positions, a locking member being elongated and extending transverse to said pivot axis for movement across said fixed member and being movably supported on said second handle portion and having a surface positionable in selective contact with said fixed member surfaces for respectively securing said second handle portion in said positions and with said locking member being movable independent of any movement of said second handle portion and to a location to have said locking member surface movable out of contact with said fixed member surfaces, a spring operative on said locking member for yieldingly urging said locking member surface into contact with said fixed member surfaces, said locking member has a relief therein adjacent said locking member surface and being positionable contiguous to said fixed member surfaces to establish said non-lock mode, and a button movably supported on the exterior of said second handle portion and being in contact with said locking member for moving said locking member transverse to said pivot axis.

17. A hand-manipulated torque tool comprising:

a first handle portion having a longitudinal axis and a receptor for supporting a work tool, a second handle portion pivotally connected with said first handle portion and being pivotal on a pivot axis extending transverse to said longitudinal axis and being pivotal to a position of alignment with said axis and a position transverse to said axis, a fixed member fixedly supported by said first handle portion and is disposed and extends along said pivot axis and has two surfaces oriented to be respectively compatible with said positions, a locking member being elongated and extending transverse to said pivot axis for movement across said fixed member and being movably supported on said second handle portion and having a surface positionable in selective contact with said fixed member surfaces for respectively securing said second handle portion in said positions and with said locking member being movable independent of any movement of said second handle portion and to a location to have said locking member surface movable out of contact with said fixed member surfaces, a spring operative on said locking member for yieldingly urging said locking member surface into contact with said fixed member surfaces, said second handle portion having a longitudinal axis extending transverse to said pivot axis and having an end on said second handle portion located on said longitudinal axis, said second handle portion being pivotally connected with said first handle portion to have said end always disposed distal from said first handle portion throughout the pivoting to and between said positions, and a button movably supported on said end of said second handle portion and being in contact with said locking member for moving said locking member transverse to said pivot axis.

* * * * *